United States Patent [19]

Capriotti

[11] 4,074,895

[45] Feb. 21, 1978

[54] TORCH AND CUTOFF TABLE ARRANGEMENT

[75] Inventor: Alfred J. Capriotti, Falls Township, Bucks County, Pa.

[73] Assignee: United States Steel Corporation, Pittsburgh, Pa.

[21] Appl. No.: 763,445

[22] Filed: Jan. 28, 1977

Related U.S. Application Data

[63] Continuation-in-part of Ser. No. 603,836, Aug. 11, 1975, abandoned.

[51] Int. Cl.[2] ..... B23K 7/00
[52] U.S. Cl. ..... 266/50
[58] Field of Search ..... 164/263, 264; 266/50

[56] References Cited

U.S. PATENT DOCUMENTS

| | | | |
|---|---|---|---|
| 3,443,803 | 5/1969 | Wernicke | 266/50 |
| 3,788,620 | 1/1974 | Lotz | 266/50 |

*Primary Examiner*—Gerald A. Dost
*Assistant Examiner*—Paul A. Bell
*Attorney, Agent, or Firm*—William A. Danchuk

[57] ABSTRACT

A torch cutoff table and arrangement is provided for the cutting of steel product and the like. The cutoff table arrangement is employed with a torch which is movable in a first direction parallel to the direction of movement of the product across the table and in a second direction to effect a cutting of the product perpendicular to the direction of movement of the product across the cutoff table. The cutoff table arrangement provides for the support of the product as it is moved across the table without interference with the torch as the latter is moved in the two directions simultaneously.

12 Claims, 5 Drawing Figures

TORCH AND CUTOFF TABLE ARRANGEMENT

This application is a continuation-in-part of application Ser. No. 603,836, and now abandoned, filed Aug. 11, 1975.

BACKGROUND OF THE INVENTION

Cutoff tables and torch arrangements have been used in the steel industry in both manual and automatic situations for some time. The cutoff tables and automatic torches were introduced into the steel industry along with the advent of the continuous casting machines for heavy steel product which is not suitable for cutting with shears or alternate methods.

Due to the necessity of continuously moving the steel product as it is passed out of the continuous casting machine, the cutoff tables and torches presently used have to provide for the movement of the torch assembly with the product in the direction of the product as the latter is moved across the cutting table. In addition to this movement, the torch assembly must move in a direction across the steel product such that it affects a perpendicular cut of the product into smaller manageable sized pieces. Accordingly, the locus of travel of the torch assembly relative to a given stationary point is a diagonal line extending between its starting point and its finishing point. The cutoff table and torch arrangements generally utilize torches of the gas cutting variety although present technology dictates that torches of the laser and plasma arc variety will soon be introduced into the steel industry.

While technological development has occurred in the torch field, the cutoff table arrangements associated with the former have lagged far behind. Specifically, the torch cutoff tables presently employed utilize an endless chain conveyor which both supports and transfers the product as the latter is passed under the influence of the torch cutting assembly. Such cutoff table arrangements are generally expensive due to the size and strength necessary of the component parts of the movable cutoff table arrangement. In addition, the cutoff table arrangements described above are susceptible of mechanical failure of the linkages, the axles, and the wheels which make up the cutoff tables presently used today. Moreover, experience has shown that the torches used with the movable cutoff table assembly actually cut through the support members of the continuous chain conveyor. When cut, the support members are no longer effective and must be replaced, thereby necessitating downtime and expense. When not cut, the support members of the continuous chain conveyor table are susceptible to slag buildup along their length. If this occurs at a non-joint location along the support member, there is the possibility that the production will not be supported in a level manner, thereby influencing the quality of the product subsequent to its cut. Should the buildup occur at a joint section of the support member, there exists the possibility of damage or breakage to the joint which again would result in increased downtime and expense of repair. Accordingly, there is the need for a more efficient method and apparatus for effecting the necessary cutting of a continuous casting product without the maintenance and expense associated with currently employed cutoff table - torch arrangements.

SUMMARY OF THE INVENTION

The present invention is addressed to cutting table arrangement for steel product and the like, especially that emanating from a continuous casting machine. The apparatus may be effectively practiced relative to a continuous casting machine or in any environment in which the product being cut must be moved during cutting.

The cutting table arrangement, in its most fundamental form, is stationary cutoff table onto which and from which the steel product is moved. The cutoff table arrangement is based upon the principle of removing product supports of the table in that area defined by the locus of travel of the torch or torches as the latter are moved with the product and across the product to effect the cut. The area defined by the locus of travel of the torch or torches takes into consideration the combination and permutations inherent in both the minimum and maximum given speeds of both the product and the torch or torches as the latter are moved across the product. Accordingly, due to the lack of any moving parts, and the removal of support material directly under the influence of the torch, a more efficient and more easily maintained cutoff table arrangement is provided.

It is therefore a primary object and feature of the present invention to provide a cutoff table arrangement for supporting steel product or the like, as the latter is moved across the table and is cut by at least one cutting mechanism.

It is a further primary object and feature of the present invention to provide a non-movable cutoff table arrangement for supporting steel product as the latter is cut by at least a single torch, the latter being moved in two given directions simultaneously.

It is a general object and feature of the present invention to provide a cutoff table and torch arrangement for selectively cutting steel product moving in a given direction across the table, the torch being movable in one direction normal to the given direction of movement of the product and being simultaneously movable in the given direction of movement of the product across the table, the table including support structure having an area voided therein which is configured of a size and shape substantially equal to that area defined by the permutations of the maximum and minimum speeds of the workpiece and the torch.

Other objects and features of the invention will, in part, be obvious and will, in part, become apparent as the following description proceeds. The features of novelty which characterize the invention will be pointed out with particularity in the claims annexed to and forming part of the specification.

BRIEF DESCRIPTION OF THE DRAWINGS

The novel features that are considered characteristic of the invention are set forth with particularity in the appended claims. The invention itself, however, both as to its structure and its operation together with the additional objects and advantages thereof will best be understood from the following description of the preferred embodiment of the invention when read in conjunction with the accompanying drawings wherein:

DETAILED DESCRIPTION OF THE INVENTION

Figure 3:
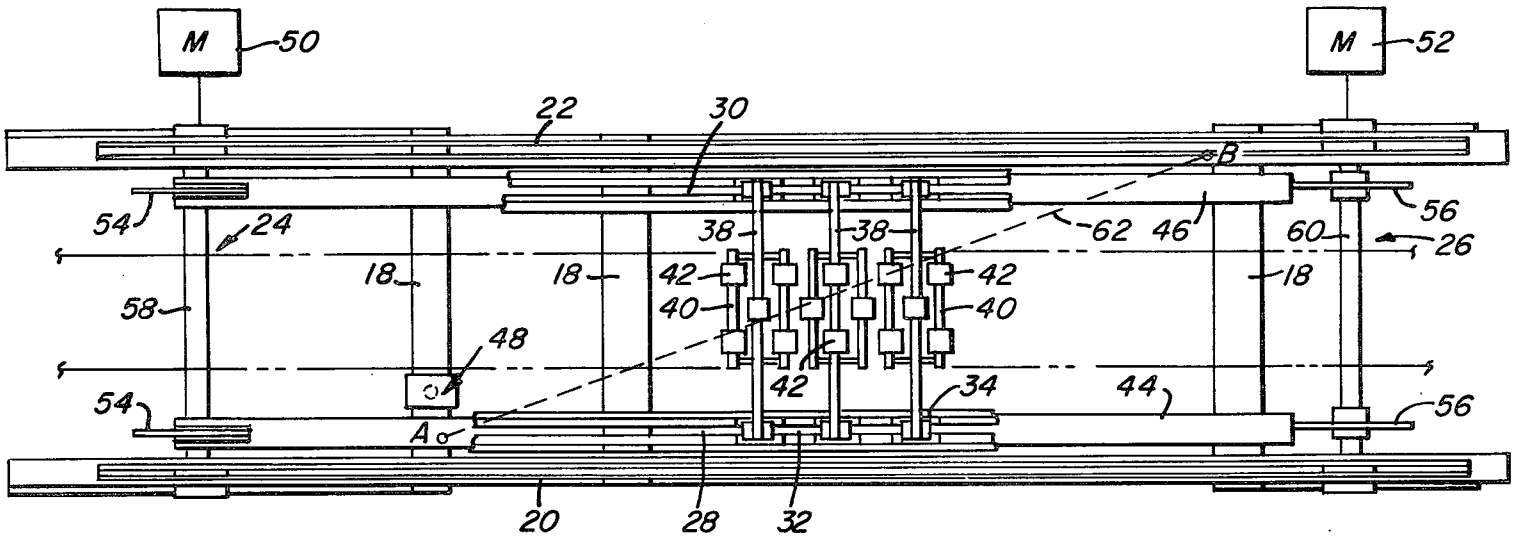
FIG. 3 (PRIOR ART)
FIG. 3 is an elevational view of the apparatus currently being employed and is labeled prior art.
Figure 4:
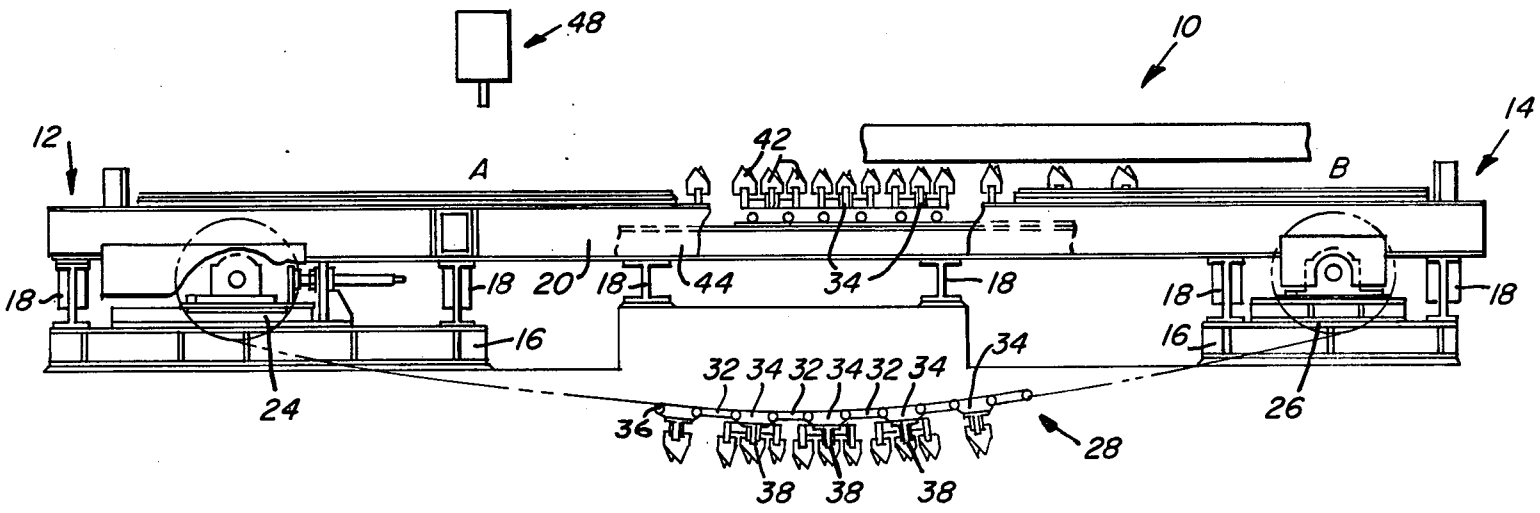
FIG. 4 (PRIOR ART)
FIG. 4 is a plan view of the apparatus of FIG. 3 and is labeled prior art.

Referring to FIGS. 3 and 4, there is shown a torch and cutoff table arrangement 10 which is presently being employed and which is labeled prior art. Thr torch and cutoff table arrangement 10 is generally configured having an input side 12 and an exit side 14 into which and from which the steel product from the continuous casting machine (not shown) is moved and extracted, respectively. The arrangement 10 includes structural support members 16, 18, 20, and 22. Positioned proximate sides 12 and 14 are two pulley arrangements 24 and 26, respectively. Extending between the pulley arrangements 24 and 26 and located on either side of the cutoff table arrangement 10 are two chain conveyors shown generally at 28 and 30 located along structural support elements 20 and 22, respectively. Each of the chain conveyors is composed of a plurality of linkages 32 and supporting elements 34. The linkage elements 32 and support elements 34 are connected together through a series of pins, as at 36, along the entire length of chain conveyors 28 and 30.

Extending between each of the chain conveyors 28 and 30 are a plurality of flight bars 38 (see FIG. 3). Supported laterally from flight bars 38 are a plurality of satellite flight bars 40. The flight bars 38 and flight bars 40 have a plurality of product support elements 42 connected thereto which support the product as it is passed across the torch and cutoff table arrangement 10.

While the satellite flight bars 40 have been shown only to partially extend between the conveyor chains 28 and 30 in the cutoff table arrangement 10, it should be obvious that they too may extend entirely between the chain conveyors 28 and 30 as do the flight bars 38. However, for purposes which will become apparent below, the satellite flight bars 40 generally do not extend the full length between the chain conveyors 28 and 30.

The conveyor chains 28 and 30 each extend about the pulley arrangements 24 and 26 in such a manner that the conveyor chains are permitted to sag beneath the pulley arrangement as shown in FIG. 4 and are supported in their upper line of travel by inner support beams 44 and 46 located proximate structural support elements 20 and 22, respectively.

Positioned above the table arrangement 10 is a torch arrangement 48. Torch arrangement 48 is supported above the product for movement along with the product as the latter is moved between points A and B as shown in FIG. 4. The specific design of the torch arrangement, its structure (not shown), the mechanism for moving the torch arrangement along with the product, and the specific arrangement of the torch or torches are well known in the steel industry and will not be described here in further detail.

The chain conveyors 28 and 30, as well as the flight bars 38, the satellite flight bars 40, and the product support elements 42 are driven between the pulley arrangements 24 and 26 by motors represented in schematic as at 50 and 52. As may be evidenced from FIG. 3, the pulley arrangements 24 and 26 are configured having sprocket elements 54 and 56 located proximate thereto, respectively. Connecting each of the sprockets 54 is a shaft 58 which serves to join the two so as to effect an equal rotation of each chain 28 and 30 about the sprockets 54 located on either side of the table arrangement 10. In much the similar manner, a shaft 60 is provided between the sprockets 56 located proximate the exit side 14 of the cutoff table arrangement 10.

The torch and cutoff table arrangement 10 both supports the product as it is moved across the table and effects a cut across the product perpendicular to the direction of movement of the product from input side 12 to exit side 14. The torch arrangement 48, due to its two directional movement, moves from point A to point B in a general diagonal fashion as indicated by dashed line 62 in FIG. 3. As the torch arrangement 48 moves from point A to point B on the cutoff table arrangement 10, it is moved in parallel fashion to the flight bars 38 and satellite flight bars 40. The torch 48 moves along with the chain conveyors and associated flight bars when actuated, and has the possibility of cutting through one of the flight bars 38 or the satellite flight bars 40 during this movement. Applicant's operating experience has shown that the torch arrangement 48 is aligned with one of the flight bars or satellite flight bars enough times during a single day's operation of the table arrangement 10 to cut through at least 3 or 4 flight bars or satellite flight bars. Additionally, the operation of the torch arrangement 48 produces slag from the steel product being cut which builds up both on the product support elements 42 as well as the flight bars 38 and the satellite flight bars 40. Accordingly, when such a buildup continues for any extended period of time, the product is no longer supported by the above-noted elements in a level or perfectly horizontal status. As a result, succeeding cuts to the product are not within the tolerances and specifications demanded by both the customer and the producer.

It should be obvious that the maintenance of such a chain conveyor based torch and cutoff table arrangement, with its plurality of moving parts, is susceptible to damage and breakage of the elements during normal operation. Such breakage and damage leads to unproductive downtime, maintenance costs and the high expense of substitution parts for those damaged or broken. As a result of this inefficient operation, the present torch and cutoff table arrangement has been developed.

Figure 1:
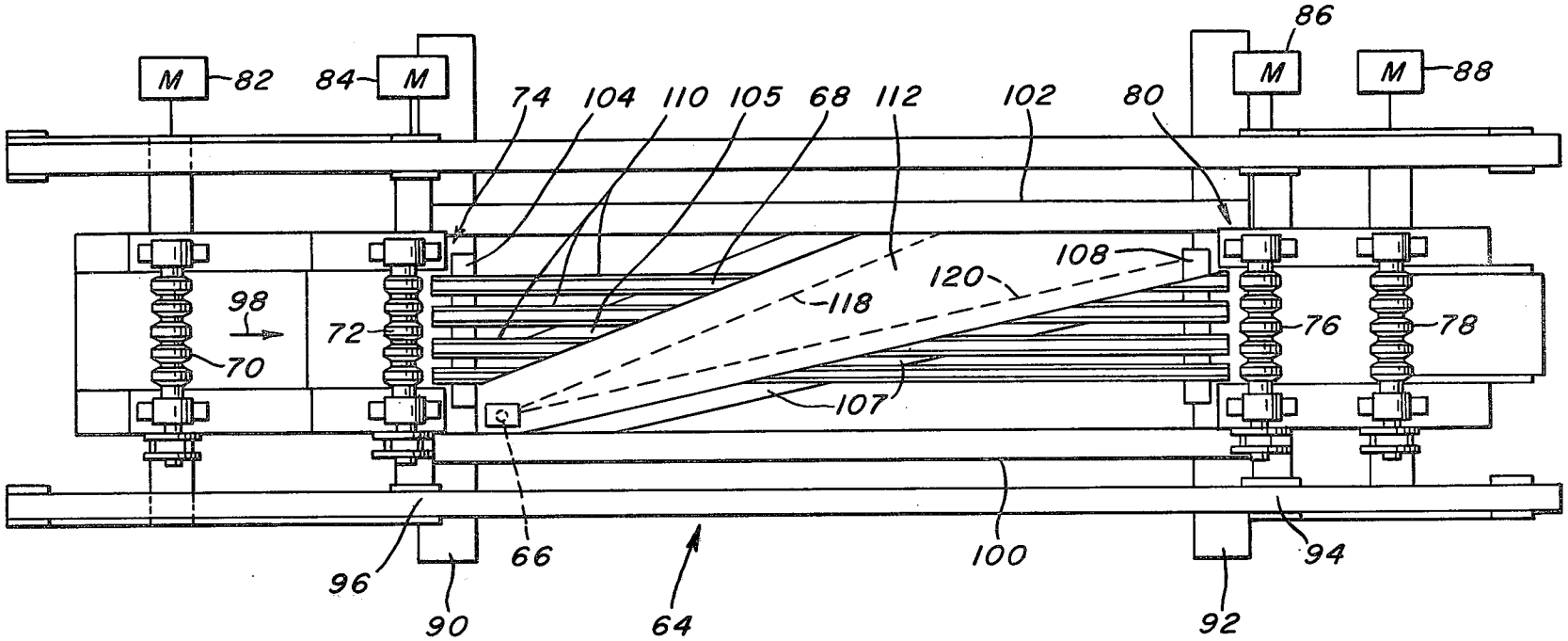
FIG. 1 is a plan view of the cutoff table arrangement according to the present invention.

Looking to FIGS. 1 and 2, the present torch and cutoff table arrangement generally indicated at 64 and its operational basis will be described. The torch and cutoff table arrangement 64 has an associated torch 66 and a cutoff table 68. Located on either end of table 68 are two pairs of driving rollers which are indicated at 70 and 72 at the entrance side 74 of the torch and cutoff table arrangement 64 and two more driving rollers indicated at 76 and 78 proximate the exit portion 80 of the cutoff table 68. Associated with each of the rollers 70, 72, 76, and 78 are driving motors indicated in schematic form at 82, 84, 86 and 88, respectively. Motors 82, 84, 86, and 88 provide rotational driving force to the rollers for moving the steel product onto and extracting the steel product from the cutting table 68.

The table 68 per se is configured having a plurality of major structural support beams 90, 92, 94, and 96 which are oriented normal to the direction of product movement as indicated by arrow 98. Located on top of the existing structural support beams 90, 92, 94, and 96 are two major structural beams 100 and 102. Beams 100 and 102 support the rollers 70, 72, 76, and 78 as well as three transversely oriented smaller support beams 104 and 108. Located on top of the transversely oriented support beams 104 and 108 are a plurality of longitudinally oriented skids 110 which are fabricated from rail sections commonly available in the steel industry. Two other rail supports 106 and 107 extend angularly between beams 100 and 102, as shown in FIG. 1, and provide support for the rails or skids 110 proximate the void or space 112. It should be noted that no supporting structure is located within the voided area in which the torch 66 cuts. Accordingly, no supporting structure may be cut or be in a position to accumulate slag and cuttings from the product as it is being cut.

As noted with respect to prior art in FIGS. 3 and 4, the torch therein noted had a locus of travel along the dashed line 62 between its initial point A and its terminal point B. While the locus of travel of the torch between points A and B was correctly stated as the diagonal line 62, this was merely an average of the combinations and permutations resulting from the differences between a minimum and maximum torch speed across the table as well as the movement of the torch between minimum and maximum speed limits along with the product as the product is moved across the table. Should both the product and the torch move at exact speeds each and every time, there would be no need to selectively configure the table support surface 68 as is shown in FIG. 1. This, however, is not the case. The torch 66 moves across table 68 between a minimum given speed and a maximum given speed. Similarly, the product moves across the table 68 from the entrance side 74 to the exit side 80 of the table between minimum and maximum given speeds. This interrelationship between torch speed and product speed is best evidenced by referring to FIG. 2.

Figure 2:
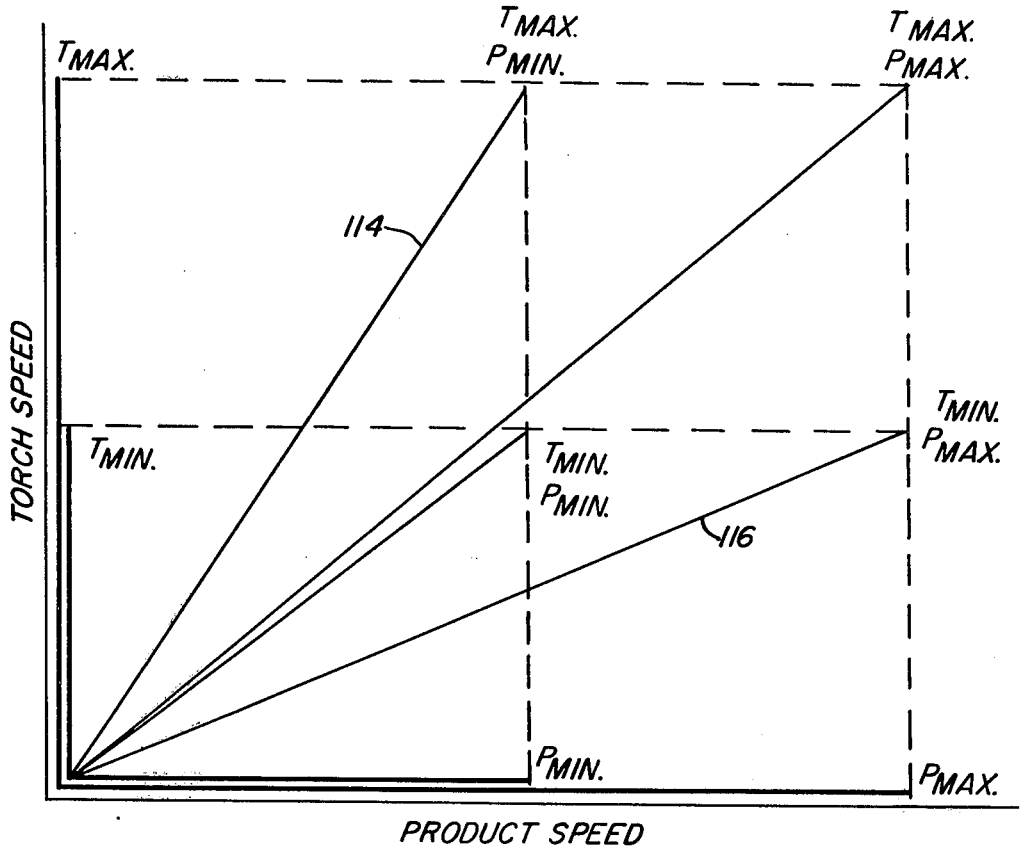
FIG. 2 is a graph showing the relationships of torch speed to product speed with the resultant vectors associated therewith.

As shown in FIG. 2, the vectors which are formed as a result of the combination and/or permutations of the minimum and maximum torch speeds as well as the minimum and maximum product speeds are shown. A study of the graph depicted in FIG. 2 shows that all combinations and permutations of minimum and maximum torch speeds and minimum and maximum product speeds lie within the vectors defined by the maximum torch speed and minimum product speed and the vector defined by the minimum torch speed and the maximum product speed. Consequently, no combination or permutation of torch speed and product speed, within given minimum and maximums, will lie without these vectors. Therefore, the voided area 112 formed within the support portion of the table defined by the skids 110 has a configuration and shape which is substantially similar to that shown between the limiting vectors shown at 114 and 116, which were previously discussed. In order to provide for a safety factor, the exact configuration of the voided area 112 defined by the skids 110 has been widened to some degree, but has its basic configuration and shape dictated by the combination of torch speed and product speed between the previously discussed limits. Consequently, the torch 66 will have a locus of travel when it is operating at maximum torch speed and the product is moving at minimum line speed shown by line 118 in FIG. 1. Similarly, the torch 66 will have a locus of travel indicated by dashed line 120 in FIG. 1, which is defined by the combination of the maximum product speed with the minimum torch speed. All other combinations and permutations of the torch speed and the product speed within the priorly defined maximum and minimum limits will fall within the voided area 12 contained within the dashed lines 118 and 120. As a result of this configuration, all material susceptible of being cut, or upon which slag may be built up, is removed from under the influence of the torch 66 as it is moved from its initial point as shown in FIG. 1 to its terminal point on the other side of the table 68. The above-noted configuration is especially effective and efficient due to the lack of any moving parts proximate the torch and the absence of any replacement material which may be cut by the torch as it cuts the product.

Figure 5:
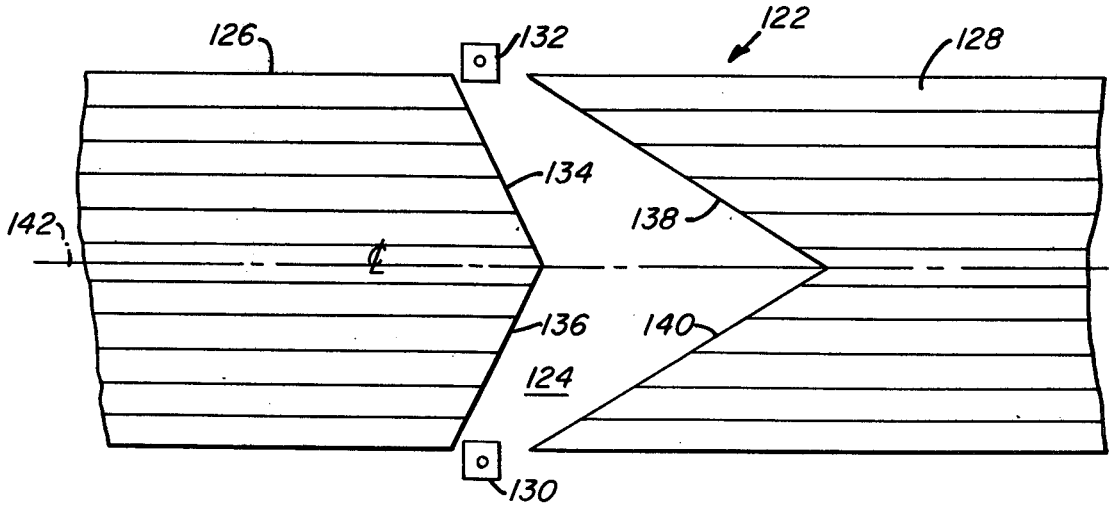
FIG. 5 is a plan schematic view of a second embodiment according to the present invention.

The prior description presumes that a single torch is moved from one side of the product to the other in order to effect a perpendicular cut to the product as it is moved from the entrance side 74 of the cutting table to the exit side 80. This presumption is true in the majority of cases of cutting tables and associated torches in steel mills and along casting lines. However, there are installations in which dual torches act in concert to effect a perpendicular cut across the product, each torch cutting substantially one half of the product. Looking to FIG. 5, there is shown a second embodiment of the present invention in which the cutting table and the associated void located therein are configured to accommodate the dual torch arrangement. Specifically, in the embodiment shown in FIG. 5, a cutoff table 122, similar in structure to that shown in FIG. 1 is configured having a void 124 located therein which separates the table 122 into two components 126 and 128. Two torches, as at 130 and 132, are located at their initial positions on the outward sides of the table 122 and are movable from these positions toward the center line of the product as it passes across table 122, each torch cutting through one half of the product. The configuration of the void 124 located within the cutting table 122 is chevron shaped due to the duplication of torches. It should be obvious, however, that the configuration of the table for each of the torches alone is exactly similar to that presented in FIG. 1. Specifically, the lower boundaries 134 and 136 of the table 122 are formed by the locus of travel of the torches 130 and 132, respectively, when the product is moved at a minimum speed and the torches 130 and 132 are moved at their maximum speeds. Similarly, the boundaries 138 and 140 of the table 122 are formed by the locus of travel of the two torches 132 and 130 when the product is moved at a maximum speed and the torches 132 and 130 are moved at their minimum speeds, respectively. The center line of the product indicated at 142 represents a center line of symmetry of the table with each side being similar to that shown in FIG. 1 in which only one torch was presented.

It should be apparent that the torch and cutoff table assembly of the present invention provides for a multitude of advantages over the currently used assemblies. In particular, the present cutoff table does not have any of the moving parts which are susceptible to breakage or damage thereby resulting in the necessity of repairing the same which in turn, results in inefficient downtime and added expense. Additionally, the removal of all supporting structure as well as rail or skid material from under the path of the torch during the combinations of torch speed and product movement speed results in the obviation of repair to flight bars or satellite flight bars and their accompanying expense and downtime. The lack of support structure also precludes the build up of slag and cuttings upon structure located below the torch path as well as precluding the cutting of such structure by the torch. While the subject of downtime has been noted herein, it should be emphasized that a continuous casting machine must be operated on a fairly continuous basis in order to provide for an efficient operation. While such continuous casting machines themselves are susceptible to their own breakdown and repair, it should be obvious that any other adjacent system should be designed with the most efficient operation and minimization of downtime possible. Accordingly, the present invention meets these requirements and does not burden the continuous casting maintenance personnel with extraneous problems not directly associated with the continuous casting machine per se.

While certain changes may be made in the above system and assembly without departing from the scope of the invention herein involved, it is intended that all matter contained in the above description or shown in the accompanying drawings shall be interpreted as illustrative and not in a limiting sense.

I claim:

1. A torch and cutoff table arrangement for selectively cutting a workpiece moving in a given direction across the cutting table, the workpiece having a given rate of movement established between a maximum rate and a minimum rate, said cutoff table apparatus including:

means for moving the workpiece toward the cutting table, said moving means having both a minimum and a maximum velocity;

means for removing the workpiece from the cutting table;

means for cutting the workpiece, said cutting means being movable in a direction normal to said given direction and being simultaneously movable at the same rate and direction as the workpiece, the cutting means having an established maximum speed and an established minimum speed; and fixed support means defining the cutting table, said support means having means defining a void in the support means configured of a size and shape which is substantially equal to that area defined by the permutations of the maximum and minimum speeds of the workpiece and the cutting means, no portion of said fixed support means extending within said void or below said voided area, thereby preventing the cutting of said support means or the build-up thereupon of slag or waste product from the cutting operation.

2. The torch and cutoff table arrangement according to claim 1 in which said means defining said void in said support means is configured having one of its boundaries defined by the locus of travel of said cutting means when said cutting means is moved in said direction normal to said given direction at its maximum speed and along with such workpiece when such workpiece is moved in said given direction at its minimum speed, the other boundary being defined by the locus of travel of said cutting means when said cutting means is moved in said direction normal to said given direction at its minimum speed and along with such workpiece when such workpiece is moved in said given direction at its maximum speed.

3. A cutting table arrangement for use in conjunction with a product being moved across the cutting table arrangement in a given direction at a given speed, said cutting table arrangement comprising:

cutting means movable in a first direction parallel to said given direction with such product at a velocity equal to said given speed and in a second direction at a second given speed normal to said first direction such that said cutting means is passed across said product for cutting said product; and means defining said cutting table, said cutting table defining means including:

first fixed support means upon which the remainder of said cutting table defining means is supported;

second fixed support means for supporting such product as it is moved across said cutting table, said second fixed support means being configured having means defining a voided area in said second support means, said voided area being located in that portion of said cutting table traversed by said cutting means as it moves in both its first and second direction to cut such product, neither said first support means nor said second support means extending within or below said voided area, thereby preventing possible cutting of said first and second support means or the build-up thereupon of slag or waste product from the cutting operation.

4. The cutting table arrangement according to claim 1 in which said cutting means is movable in both said first and second directions at speeds established between a minimum and a maximum given speed, said product being moved across said cutting table at a speed established between a minimum and maximum speed, said voided area of said cutting table having a shape and size defined by the combination and permutations of the minimum and maximum given speeds of both the product and of said cutting means as the latter is moved in said second given direction.

5. A cutting table arrangement for steel product and the like, the product being moved across the cutting table arrangement in a given direction at a given speed, said cutting table arrangement comprising:

cutting means movable in a first direction parallel to said given direction with such steel product at a velocity equal to said given speed and in a second direction at a second given speed normal to said first direction such that said cutting means is passed across said product for cutting said product, both said given speed of said product and said second given speed of said cutting means being established between minimum and maximum given speeds; and means defining said cutting table, said cutting table defining means including first fixed support means for supporting the remainder of said cutting table defining means and second fixed support means for supporting such product as it is moved across said cutting table, said second fixed support means being configured having means defining a voided area in said second support means, said voided area being located in that portion of said cutting table traversed by said cutting means as it moves in both its said first and second directions, said voided area being configured having a shape and a size defined by the combination and permutations of the minimum and maximum given speeds of both the product and of said cutting means as the latter is moved in said second given direction, no portion of said first and second support means extending within or below said voided area, thereby preventing possible cutting of said first or second support means or the build-up of slag thereupon from the cutting operation.

6. The cutting table arrangement according to claim 5 in which said means defining said void in said second support means is configured having one boundary defined by the locus of travel of said cutting means when said cutting means is moved in said second given direction at its maximum speed and along with such product when such product is moved in said given direction at its minimum speed.

7. The cutting table arrangement according to claim 5 in which said means defining said void in said second support means is configured having one boundary defined by the locus of travel of said cutting means when said cutting means is moved in said second given direction at its minimum speed and along with such product when such product is moved in said given direction at its maximum speed.

8. The cutting table arrangement according to claim 5 in which said means defining said void in said second support means is configured having one of its boundaries defined by the locus of travel of said cutting means when said cutting means is moved in said second given direction at its maximum speed and along with such product when such product is moved in said given direction at its minimum speed, the other boundary being defined by the locus of travel of said cutting means when said cutting means when said cutting means is moved in said second given direction at its minimum speed and along with such product when such product is moved in said given direction at its maximum speed.

9. A cutting table arrangement for steel product and the like, the product being moved across the cutting table arrangement in a given direction at a given speed, said cutting table arrangement comprising:

cutting means movable in a first direction parallel to said given direction with such steel product at a velocity equal to said given speed and in a second direction at a second given speed normal to said first direction such that said cutting means is passed across said product for cutting said product, both said given speed of said product and said second given speed of said cutting means being established between minimum and maximum given speeds; and means defining said cutting table, said cutting table defining means including first support means for supporting the remainder of said cutting table defining means and second support means for supporting such product as it is moved across said cutting table, said second support means being configured having means defining a voided area in said second support means, said voided area being located in that portion of said cutting table traversed by said cutting means as it moves in both its said first and second directions, said voided area being configured having a shape and a size defined by the combination and permutations of the minimum and maximum given speeds of both the product and of said cutting means as the latter is moved in said second given direction, no portion of said first and second support means extending within or below said voided area, thereby preventing possible cutting of said first or second support means or the build-up of slag thereupon from the cutting operation, said second support means being formed as rails, said rails being positioned parallel to one another and parallel to said first direction, said rails being discontinued in said voided area, thereby being removed from the influence of said cutting means.

10. The cutting table arrangement according to claim 5 in which said cutting means is a single torch, said voided area having a generally pie-shaped configuration with one side defined by the locus of travel of the single torch as it is moved in said second given direction at its maximum speed and along with such product as such product is moved in said given direction at its minimum speed, the other side of said voided area being defined by the locus of travel of said single torch as it is moved in said second given direction at its minimum speed and along with such product as such product is moved in said given direction at its maximum speed.

11. A torch and cutoff table arrangement for selectively cutting steel product or the like, the product being moved across the cutting table arrangement in a given direction at a given speed between a maximum and a minimum speed, said cutting table arrangement comprising:

cutting means, formed as a pair of torches, movable together in a first direction parallel to said given direction along with and at the same speed as such product, each one of said torches being movable in a second direction normal to said first direction at a second given speed between a maximum and a minimum speed such that each of said torches is passed across approximately one-half of said product for combinedly effecting a cutting of such product normal to said given direction of movement of such product; and means defining said cutting table, said cutting table defining means including first fixed support means for supporting the remainder of said cutting table defining means and second fixed support means for supporting such product as it is moved across said cutting table, said second fixed support means being configured having means defining a voided area in said second fixed support means, said voided area being located in that portion of said cutting table traversed by said pair of torches as they move in both their said first and second directions, said voided area being configured having a shape and a size defined by the combination and permutations of the minimum and maximum given speeds of both the product and of said pair of torches as the latter are moved in their said second given direction, no portion of said first and second support means extending within or below said voided area, thereby preventing possible cutting of said first or second support means or the build-up of slag thereupon from the cutting operation.

12. The torch and cutoff table arrangement according to claim 11 in which said two torches are moved toward each other during their movement in said second direction, said voided area therefore having a general chevron shape with boundaries defined along one side of the chevron by the locus of travel of said two torches as said torches are moved toward each other in said direction normal to said given direction at equal maximum speeds and along with such product as such product is moved in said given direction at its minimum speed, the other boundary of the chevron being defined by the locus of travel of said two torches as said torches are moved toward each other in said direction normal to said given direction at equal minimum speeds and along with such product as such product is moved in said given direction at its maximum speed.

* * * * *

UNITED STATES PATENT OFFICE

CERTIFICATE OF CORRECTION

Patent No. 4,074,895 Dated February 21, 1978

Inventor(s) Alfred J. Capriotti

It is certified that error appears in the above-identified patent and that said Letters Patent are hereby corrected as shown below:

Col. 5, line 66, change "12" to -- 112 --.

Col. 8, line 22, change "claim 1" to -- claim 3 --.

Signed and Sealed this

*Fifteenth* Day of *August 1978*

[SEAL]

*Attest:*

RUTH C. MASON
*Attesting Officer*

DONALD W. BANNER
*Commissioner of Patents and Trademarks*